US005181006A

United States Patent [19]

Shafe et al.

[11] Patent Number: 5,181,006

[45] Date of Patent: Jan. 19, 1993

[54] METHOD OF MAKING AN ELECTRICAL DEVICE COMPRISING A CONDUCTIVE POLYMER COMPOSITION

[75] Inventors: Jeff Shafe; O. James Straley, both of Redwood City; Gordon McCarty, San Jose; Ravinder K. Oswal, Union City; Amitkumar N. Dharia, Newark, all of Calif.

[73] Assignee: Raychem Corporation, Menlo Park, Calif.

[21] Appl. No.: 805,212

[22] Filed: Dec. 11, 1991

Related U.S. Application Data

[62] Division of Ser. No. 247,026, Sep. 20, 1988, Pat. No. 5,093,036.

[51] Int. Cl.[5] ..... H01C 7/10; H01C 7/13

[52] U.S. Cl. ..... 338/22 R; 338/22 SD; 427/58; 427/256; 427/287

[58] Field of Search ..... 252/511; 260/DIG. 38; 427/256, 287, 58; 338/22 R, 22 SD

[56] References Cited

U.S. PATENT DOCUMENTS

| | | | |
|---|---|---|---|
| 4,482,476 | 11/1984 | Yoshimura et al. | 252/511 |
| 4,491,536 | 1/1985 | Tomoda et al. | 252/511 |
| 4,628,187 | 12/1986 | Sekiguchi et al. | 219/505 |
| 4,722,853 | 2/1988 | Batliwalla et al. | 426/256 |
| 4,818,439 | 4/1989 | Blackledge et al. | 252/511 |

FOREIGN PATENT DOCUMENTS

| | | |
|---|---|---|
| 0068168 | 5/1983 | European Pat. Off. . |
| 0085413 | 10/1983 | European Pat. Off. . |
| 0217512 | 8/1987 | European Pat. Off. . |
| 0235454 | 9/1987 | European Pat. Off. . |

OTHER PUBLICATIONS

"Cabot Carbon Blacks for Ink, Paint, Plastics, Paper", Technical Report S-36, Cabot Corporation, May, 1983.

*Primary Examiner*—Michael Lusignan
*Attorney, Agent, or Firm*—Marguerite E. Gerstner; Timothy H. P. Richardson; Herbert G. Burkard

[57] ABSTRACT

A polymer thick film ink which exhibits PTC behavior comprising an organic polymer which is crystalline, an active solvent suitable for dissolving the polymer, and carbon black which has a pH of less than 4.0. The ink is particularly useful in producing electrical devices such as heaters and circuit protection devices.

18 Claims, 1 Drawing Sheet

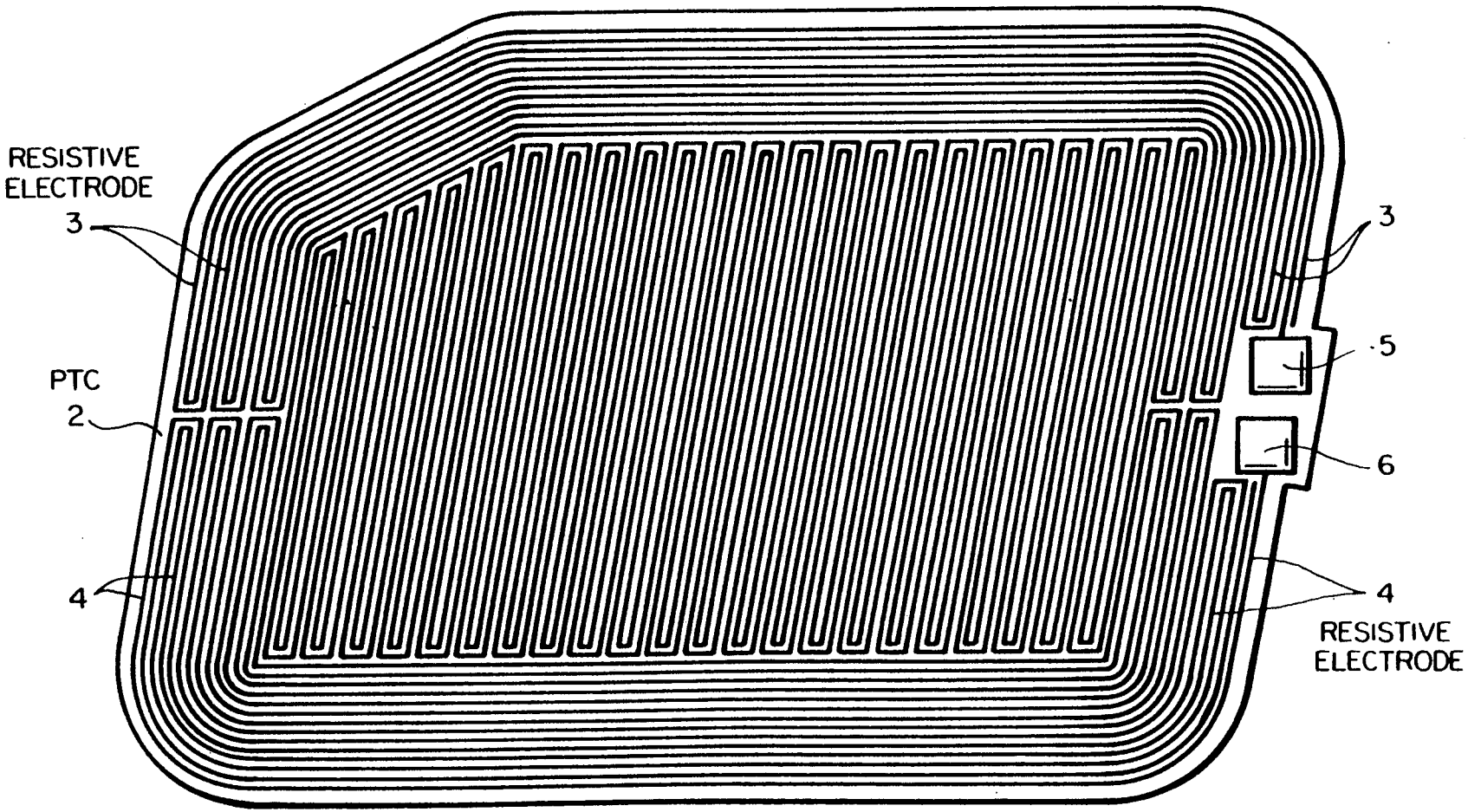
FIGURE

METHOD OF MAKING AN ELECTRICAL DEVICE COMPRISING A CONDUCTIVE POLYMER COMPOSITION

CROSS-REFERENCE TO RELATED APPLICATIONS

This application is a divisional application of copending, commonly assigned application Ser. No. 07/247,026 (Shafe et al), filed Sep. 20, 1988, now U.S. Pat. No. 5,093,036, the disclosure of which is incorporated herein by reference.

BACKGROUND OF THE INVENTION

Field of the Invention

This invention relates to conductive polymer compositions for use as polymer thick film inks and methods of making said inks.

Thick film inks for use as resistors, connectors and other electrical components are known. These conventional inks normally exhibit ZTC behavior (zero temperature coefficient of resistance), i.e. they maintain a relatively constant resistance value over a temperature range of interest. The inks are usually applied via screen-printing or other means to a rigid substrate, e.g. alumina, beryllia, or glass; the rigid substrate serves to minimize any resistance change due to volume expansion of the substrate. Thick film inks usually comprise a conductive filler, e.g. graphite, ruthenium, or silver, in a glass, ceramic, or polymer binder. The binder acts as a matrix for the conductive filler and other components. Those inks in which the binder is a polymer are known as polymer thick film inks (PTF inks).

For some applications, e.g. self-regulating heaters or circuit protection devices, materials exhibiting PTC behavior (positive temperature coefficient of resistance) are preferred. Conductive polymer compositions which exhibit PTC behavior and electrical devices comprising them are well-known. Reference may be made, for example, to U.S. Pat. Nos. 3,793,716, 3,823,217, 3,858,144, 3,861,029, 3,914,363, 4,017,715, 4,177,376, 4,188,276, 4,237,441, 4,242,573, 4,246,468, 4,286,376, 4,304,987, 4,318,881, 4,330,703, 4,334,148, 4,334,351, 4,388,607, 4,400,614, 4,425,497, 4,426,339, 4,435,639, 4,459,473, 4,514,620, 4,520,417, 4,529,866, 4,534,889, 4,543,474, 4,545,926, 4,547,659, 4,560,498, 4,571,481, 4,574,188, 4,582,983, 4,631,392, 4,638,150, 4,654,511, 4,658,121, 4,659,913, 4,661,687, 4,667,194, 4,673,801, 4,698,583, 4,719,335, 4,722,758, 4,722,853, and 4,761,541, European Patent Publication No. 38,718 (Fouts et al), International Application No. PCT/US88/00592 (McMills et al.) filed Feb. 24, 1988, and copending, commonly assigned application Ser. Nos. 818,846 (Barma) filed Jan. 14, 1986 now abandoned, 53,610 (Batliwalla et al.) filed May 20, 1987 now U.S. Pat. No. 4,777,351, 75,929 (Barma et al.) filed Jul. 21, 1987, 115,089 (Horsma et al.) filed Oct. 30, 1987 now abandoned, 124,696 (Horsma et Nov. 24, 1987 now abandoned in favor of three continuation applications, Ser. Nos. 455,715, 456,015, and 456,030, all filed Dec. 22, 1989, 150,005 (Fahey et al.) filed Feb. 4, 1988 now U.S. Pat. No. 4,780,598, 189,938 (Friel) filed May 3, 1988, now U.S. Pat. No. 4,882,466, 202,165 (Oswal et al.) filed Jun. 3, 1988, now U.S. Pat. 4,910,389, 202,762 (Sherman et al.) filed Jun. 3, 1988, 209,761 (Hughes et al.) filed Jun. 22, 1988 now abandoned, 210,054 (McMills et al.) filed Jun. 22, 1988, now abandoned 219,416 (Horsma et al.) filed Jul. 15, 1988, now U.S. Pat. No. 4,967,176 and 247,059 (Shafe et al.) filed contemporaneously with this application, abandoned in favor of a continuation application, Ser. No. 416,748, filed Oct. 3, 1989, now U.S. Pat. No. 4,980,541, the disclosures of which are incorporated herein by reference. The majority of these materials are not suitable for use as inks; rather they are melt-processed or sintered to produce self-supporting articles which have a thickness greater than about 0.002 inch (0.005 cm). The resulting articles may be inflexible and are generally unsuitable for configuration into the intricate or very thin shapes often desirable for use on flexible substrates or printed circuit boards.

U. S. Pat. No. 4,722,853 (Batliwalla et al.) discloses a method of applying a PTF ink to a substrate. For these inks, at room temperature the organic polymer binder is in the form of solid particles, i.e. not dissolved, and the solvent is a "latent" solvent, rather than a "true" solvent, for the binder.

U.S. Pat. No. 4,628,187 (Sekiguchi et al.) discloses a planar resistive heating element in which a conductive paste is screen-printed between an electrode pattern onto an insulating substrate. The conductive paste, which exhibits PTC behavior, comprises a mixture of ethylene/vinyl acetate copolymer, graphite, flame retardant, inert filler, and solvent. A phenolic resin layer deposited over the resistive element provides protection to the element and increases its resistance to thermal degradation when heated to a temperature greater than the melting point of the polymer binder.

SUMMARY OF THE INVENTION

We have now found that polymer thick films with excellent PTC anomalies, good resistance stability under thermal and electrical stress, and good flexibility can be made when the binder comprises a crystalline organic polymer and the solvent is a "true" ("active") solvent for the polymer. Thus, in a first aspect, this invention provides a polymer thick film ink which exhibits PTC behavior and which comprises (1) an organic polymer which has a crystallinity of at least 5%;

(2) an active solvent which is suitable for dissolving the polymer; and (3) carbon black which has a pH of less than 5.0.

In a second aspect, the invention provides a method of making an electrical device, said method comprising (1) mixing (a) carbon black which has a pH of less than 5.0, (b) an organic polymer which has a crystallinity of at least 5% and a melting point $T_m$, and (c) an active solvent for the polymer:

(2) allowing the polymer to dissolve in the solvent to form an ink;

(3) applying the ink to a substrate; and (4) curing said ink by heating at a temperature $T_c$ for a time sufficient to remove the solvent.

In a third aspect, this invention comprises an electrical device prepared by the method of the second aspect.

BRIEF DESCRIPTION OF THE DRAWING

The FIGURE is a plan view of an electrical device made in accordance with the invention.

DETAILED DESCRIPTION OF THE INVENTION

The polymer thick film inks of this invention exhibit PTC (positive temperature coefficient) behavior in the temperature range of interest, i.e. from room temperature (defined as 20° C. for purposes of this specification) to a temperature comparable to the melting point of the organic polymer of the binder. The melting point, Tm, is defined as the temperature at the peak of the melting curve when the polymer is measured on a differential scanning calorimeter (DSC). The terms "PTC behavior" and "composition exhibiting PTC behavior" are used in this specification to denote a composition which has an $R_{14}$ value of at least 2.5 or an $R_{100}$ value of at least 10, and preferably both, and particularly one which has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. In contrast, "ZTC behavior" is used to denote a composition which increases in resistivity by less than 6 times, preferably less than 2 times in any 30° C. temperature range within the operating range of the heater.

The binder of the thick film ink comprises an organic polymer which has a crystallinity of at least 5%, preferably at least 10%, particularly at least 15%, e.g. 20-30%. Preferred polymers are those which have a crystallinity of less than 60%, particularly less than 50%, especially less than 45%. Polymers with higher crystallinities frequently cannot be dissolved at room temperature. The crystallinity is determined by calculating the heat of fusion as measured by a DSC, and then comparing that value to the 100% crystalline value for a known reference polymer. The choice of polymer for the binder is a function of the desired solvent and the desired switching temperature, where the switching temperature, $T_s$, is defined as the temperature at the intersection point of extensions of the substantially straight portions of a plot of the log of the resistance of a PTC element against temperature which lie on either side of the portion showing the sharp change in slope. $T_s$s generally slightly less than Tm, although it may be substantially less than $T_m$ depending on the shape of the resistance vs. temperature (R(T)) curve. Suitable crystalline polymers include polymers of one or more olefins; copolymers of at least one olefin and at least one monomer copolymerisable therewith, e.g. ethylene/acrylic acid, ethylene/ethyl acrylate, and ethylene/vinyl acetate; polyalkenamers such as polyoctenamer; melt-shapeable fluoropolymers such as polyvinylidene fluoride and copolymers thereof; and blends of two or more such crystalline polymers. The term "fluoropolymer" is used herein to denote a polymer which contains at least 10%, preferably at least 25%, by weight of fluorine, or a mixture of two or more such polymers. Particularly preferred for use in an electrical heater suitable for freeze protection or mirror defrosting is a terpolymer of vinylidene fluoride, hexafluoropropylene, and tetrafluoroethylene with a melting point of about 88° C., available from Pennwalt under the tradename Kynar 9301.

Suitable solvents are those which are "active" solvents (i.e. "true" solvents) for the polymer binder. Active solvents are defined as those which are capable of interacting with the polymer to produce a mixture throughout which the components are uniformly distributed, in some cases, by dissolving the polymer at room temperature without the application of heat or shear. One skilled in the art will be able to select an appropriate active solvent for a given polymer, either by known solubility data or by experimentation. Dimethyl formamide (DMF) is particularly preferred for use with the fluorinated terpolymer (Kynar 9301). Other suitable solvents are isophorone, cyclohexanone and dimethylacetamide. A mixture of solvents may be used when two or more polymers are used in the binder. For these inks each solvent may be a true solvent for each of the polymers, or each solvent may be a true solvent for only one of the polymers. It is preferred that the boiling point of the solvent be greater than the melting point of the polymer binder.

Any carbon black capable of generating a PTC composition may be used. Suitable carbon blacks are disclosed in U.S. Pat. Nos. 4,237,441 (van Konynenburg) and 4,388,607 (Toy et al.), the disclosures of which are incorporated herein by reference. Particularly stable inks are produced when the carbon black has a pH of less than 5.0, preferably less than 4.0, particularly less than 3.0, the term "pH of less than 5.0" being used to mean that the pH of the carbon black at the time of mixing with the polymer is less than 5.0. Such blacks may be oxidized. Suitable carbon blacks are disclosed in U.S. Pat. No. 4,980,541 (Shafe et al), the disclosure of which is incorporated herein by reference. Inks comprising these low pH carbon blacks are useful for heating elements which have relatively high power outputs, i.e. at least 0.5 watt/in$^2$, preferably at least 0.75 watt/in$^2$, particularly at least 1.0 watt/in$^2$, e.g. 1.0 to 2.0 watt/in$^2$. The loading of carbon black is a function of the polymer binder, the type and conductivity of the carbon black, and the desired resistivity of the ink for each application. In general, for inks used to form the resistance element of a heater, the weight percent of carbon black is at least 4%, preferably at least 5%, particularly at least 6%. Due to the low shear of the preferred mixing process, lower carbon black loadings may be required for a given resistivity than for traditional blends. A single carbon black may be used, although blends of carbon blacks, or of carbon black and other conductive fillers (e.g. graphite, metals such as nickel, or metal oxides) may be used. When a second conductive filler is used in combination with carbon black, the carbon black comprises at least 10%, preferably at least 15%, particularly at least 20%, of the total amount of conductive filler. Inorganic or inert fillers may also be added as, for example, stabilizers, antioxidants, or flow agents.

The components of the ink may be mixed by any method which provides adequate blending, although, unlike conventional inks, the inks of this invention require no kneading or milling. In order to increase the rate at which the polymer binder dissolves, it is preferred that the polymer be in the form of a powder. The polymer powder and the conductive fillers may be be mixed together prior to the addition of the solvent, although for some inks, it is preferred that the conductive filler be mixed with the solvent prior to the addition of the polymer. In most cases, the polymer will dissolve in the solvent at room temperature within 24 to 72 hours. The rate of dissolution may be enhanced by gently heating the mixture, although it is important that the solvent remain below its boiling point. The amount of solvent present is dependent on the type of polymer and solvent, the amount of conductive and other filler, and the desired viscosity of the final ink. For screen-printing or other similar application, it is usually preferred that the ink have a viscosity of less than 20,000 cps, e.g. about 7500 to 10,000 cps, preferably 8000 to 9000 cps.

Although the polymer will be completely dissolved in the solvent, the carbon black may settle out of solution. Therefore, prior to use it may be necessary to rapidly mix the ink, e.g. by means of a high-speed blender, to generate a uniform mixture. For some applications, the PTC anomaly may be increased by melt-blending the carbon black and other fillers with the polymer prior to dissolving the polymer in the solvent. For these materials, the melt-blended composition may be pelletized, granulated, or otherwise comminuted to produce a powder which can be easily mixed with the solvent.

The ink comprises solids content which is dissolved or distributed in the solvent. The solids content refers to the quantity of polymer and fillers in the ink. Most inks of this invention have a suitable viscosity when the solvent comprises 30 to 80%, preferably 40 to 70%, of the ink by weight.

The substrate may be a rigid material, e.g. alumina or fiberglass, or a flexible material, e.g. a polymer such as polyester, polytetrafluoroethylene, or a conductive polymer. The ink may be applied by screenprinting, spraying, using a doctor blade, or any other suitable technique. It is preferred that the ink be applied in a thickness that will produce a cured layer of at least 0.001 inch (0.0025 cm) thickness. Resistive elements with such a thickness provide increased mechanical strength and higher power density capabilities. In addition, pinholes, which can lead to resistance instability, are minimized.

The ink is cured to evaporate the solvent and solidify the polymer. The term "cure" is used herein to include any solidification of the binder, whether or not it is accompanied by chemical reaction of the binder. In order to maximize the height of the PTC anomaly and ensure binding of the ink to the substrate, it is preferred that the temperature of the curing step, $T_c$, be at least as high as the melting point of the polymer binder, $T_m$, preferably greater than the melting point of the polymer binder, i.e. $T_c$ is equal to $T_m$, preferably $(T_m+10)°$ C., particularly $(T^m+20)°$ C. The curing step may be accomplished by maintaining the temperature at a constant value or by increasing it stepwise to the desired value. When it is desirable to crosslink the ink, chemical crosslinking may be conducted during the curing process, or the ink may be irradiated after the curing is completed When $T_c$ is above $T_m$, curing may be essentially completed in a time of 0.1 to 1.0 hour. Either before or after curing, a dielectric layer may be applied onto the surface of the ink to provide environmental protection and electrical and/or thermal insulation.

The inks are particularly useful in producing the resistive element for an electrical device which is a heater. The ink can be easily applied by means of screen-printing or painting onto a substrate, and can be used to produce complex patterns. The resistivity of the ink and the dimensions of the resistive element can be adjusted when heaters with different resistances, watt densities, or varying thermal requirements are needed. These inks are particularly useful in making the resistive element for heaters such as those disclosed in U.S. application Ser. No. 189,938 (Friel) filed May 3, 1988, now U.S. Pat. No. 4,882,466, the disclosure of which is incorporated herein by reference. One preferred application is the heating of mirrors or other substrates, e.g. the side mirrors or rear view mirrors on automobiles and other vehicles. Electrical devices comprising such inks are also useful as circuit protection devices. The pattern produced by the ink may be readily connected to other electronic components, e.g. thick film resistors or varistors, to produce composite devices which have thin cross-sections and rapid thermal transfer. The invention is illustrated by the drawing in which the FIGURE shows a plan view of an electrical device 1 suitable for use as a heater, in particular for use as a mirror heater. An electrode pair 3,4 forms a serpentine pattern on the surface of a resistive element 2 which comprises a conductive polymer. Electrical connection to the electrodes is made by means of spade connectors 5,6, each of which can be connected to a power source.

The invention is illustrated by the following examples.

EXAMPLES 1–4

Inks for Examples 1 to 4 were prepared to produce compositions with the solids content listed in Table I. (The final ink formulation included a specific amount of solvent as listed. The weight percent solids in the final composition equaled 100% −% DMF.) The conductive fillers (i.e. carbon black and graphite) were first blended with the solvent and mixed for 5 minutes in a high shear blender. The solution was then filtered through a 120mesh filter to remove contaminants. Powdered polymer was added to the filtered solution and allowed to stand for 24 to 72 hours. Before printing, the ink was mixed pneumatically for at least 3 minutes to produce a uniform blend with a suitable viscosity (e.g. 8000 to 9000 cps) for printing.

In order to prepare samples of each ink for testing, a silver-based ink (Electrodag 461SS, available from Acheson Colloids) was used to screen-print an interdigitated electrode pattern with 0.25 inch (0.635 cm) spacing between electrodes onto an 0.020 inch thick (0.051 cm) ethylene/ tetrafluoroethylene substrate. A layer of PTF ink was applied onto the electrode pattern by means of a doctor blade. The inks were cured by heating in air in a convection oven for 10 minutes at 57° C. followed by 15 minutes at 121° C. to produce a layer with a thickness of at least 0.001 inch (0.0025 cm). Some samples were irradiated 1 to 6 Mrads.

The resistance vs. temperature characteristics were measured by exposing the samples to five thermal cycles from 21° C. to 82° C. The resistivity at 21° C., the height of the PTC anomaly (i.e. the ratio of resistance at 82° C. to resistance at 21° C.), and the thermal stability of the inks, $R_n$ (i.e. the ratio of resistance at 21 degrees on the fifth thermal cycle to that on the first thermal cycle), are reported in Table I. Active powering of the inks at voltages from 60 to 565 VAC for 3 to 24 hours indicated that the inks were stable and displayed a constant current once a steady state condition had been reached.

TABLE I

Polymer Thick Film Ink Formulations (Weight Percent of Solids in Total Mix)

| Material | 1 | 2 | 3 | 4 | 5 |
|---|---|---|---|---|---|
| Kynar 9301 | 82.0 | 88.0 | 92.9 | 87.3 | 80.0 |
| Raven 14 | 18.0 | 12.0 | 7.1 | 3.9 | 20.0 |
| Asbury M870 | | | | 8.8 | |
| Weight % DMF | 40.0 | 65.1 | 40.0 | 63.8 | 40.0 |
| Resistivity (ohm-cm) | 16 | 100 | 1500 | 530 | 24 |
| PTC height (82° C.) | 15 | 42 | 410 | >1700 | 171 |
| $R_n$ | 1.08 | 0.96 | 1.01 | 0.98 | — |

TABLE I-continued

| Polymer Thick Film Ink Formulations (Weight Percent of Solids in Total Mix) | | | | | |
|---|---|---|---|---|---|
| Material | 1 | 2 | 3 | 4 | 5 |
| Melt process | no | no | no | no | yes |

Notes to Table I:
Kynar 9301 is a terpolymer of vinylidene fluoride, hexafluoropropylene, and tetrafluoroethylene with a melting point of about 88° C., available from Pennwalt.
Raven 14 is a carbon black with a pH of 3.0 available from Columbian Chemicals.
Asbury M870 is a natural flake graphite with an average particle size of 0.7 microns. available from Asbury Mills.
DMF is dimethyl formamide, a solvent.

EXAMPLE 5

Using a Brabender mixer, 80 wt. % powdered Kynar 9301 and 20 wt. % Raven 14 were melt-blended. The mixture was pelletized and was then allowed to dissolve in 40 wt. % DMF. The ink was pneumatically mixed, printed, and tested following the procedures of Examples 1 to 4. The results are listed in Table I.

EXAMPLE 6

Using a resist ink (PR 3003, available from Hysol), an electrode pattern was printed onto a substrate comprising 0.0007 inch (0.0018 cm) electrodeposited copper laminated onto 0.005 inch (0.0127 cm) polyester (Electroshield C18, available from Lamart). After curing the resist ink in a convection oven, the pattern was etched, leaving copper traces on a polyester backing. The copper traces produced two electrodes, each measuring approximately 0.019 inch (0.048 cm) wide and 200 inches (508 cm) long, which formed a serpentine pattern. The carbon-based ink as described in Example 1 was prepared and screen-printed onto the etched copper polyester laminate in a rectangular pattern approximately 5.5×3.5 inch (14.0×8.9 cm) to form a heater similar to that shown in the FIGURE. After curing the ink, a dielectric layer (Norcote 02049, available from Norcot®) was screenprinted onto the surface of the ink. Electrical termination was made to the heater by soldering wires onto the copper traces. When powered at 13 VDC, the heater had a power output of approximately 0.7 watts/in$^2$ (0.11 w/cm$^2$).

What is claimed is:

1. A method for producing an electrical device which comprises a conductive polymer which exhibits PTC behavior, said method comprising (1) mixing (a) carbon black which has a pH of less than 4.0, (b) an organic polymer which has a crystallinity of at least 5% and a melting point $T_m$, and (c) an active solvent for the polymer;

(2) allowing the polymer to dissolve in the solvent to form an ink;

(3) applying the ink to a substrate to form a resistive element which, when cured, will exhibit PTC behavior; and (4) curing the ink by heating at a temperature $T_c$ for a time sufficient to remove the solvent.

2. A method according to claim 1 which further comprises crosslinking the ink after step (4).

3. A method according to claim 1 wherein the carbon black and polymer are melt-mixed and pelletized prior to mixing with the solvent.

4. A method according to claim 1 wherein $T_c$ is greater than $T_m$.

5. An electrical device which comprises (1) a first electrode, (2) a second electrode, and (3) a resistive element which exhibits PTC behavior and which is supported by a substrate and which has been prepared by (a) mixing (i) carbon black which has a pH of less than 4.0, (ii) an organic polymer which has a crystallinity of at least 5% and a melting point $T_m$, and (iii) an active solvent for the polymer;

(b) allowing the polymer to dissolve in the solvent to form an ink;

applying the ink to the substrate to form the resistive element which, when cured, will exhibit PTC behavior; and (d) curing the ink by heating at a temperature $T_c$ for a time sufficient to remove the solvent, the first and the second electrodes being connectable to a source of electrical power to pass current between the electrodes.

6. An electrical device according to claim 5 which is a heater.

7. An electrical device according to claim 5 wherein the resistive element has a thickness of at least 0.001 inch.

8. An electrical device according to claim 5 which is a circuit protection device.

9. A device according to claim 6 which is a mirror heater.

10. A device according to claim 5 wherein the substrate is flexible.

11. A device according to claim 10 wherein the substrate is a polymer.

12. A device according to claim 11 wherein the substrate is polyester.

13. A device according to claim 5 wherein the carbon black has a pH of less than 3.0.

14. A device according to claim 5 wherein the carbon black has been oxidized.

15. A device according to claim 5 wherein the resistive element has been crosslinked.

16. A method according to claim 1 wherein the carbon black has a pH of less than 3.0.

17. A method according to claim 1 wherein the active solvent is suitable for dissolving the polymer at room temperature.

18. A method according to claim 1 which further includes crosslinking the ink during step (4).

* * * * *

UNITED STATES PATENT AND TRADEMARK OFFICE

CERTIFICATE OF CORRECTION

PATENT NO. : 5,181,006

DATED : January 19, 1993

INVENTOR(S) : Shafe et al

It is certified that error appears in the above-indentified patent and that said Letters Patent is hereby corrected as shown below:

In addition, the Certificate of Correction to be issued will show Column 1, line 12, delete Background of the Invention.

Column 1, line 18 after "making said inks." insert, as a new line, --Background of the Invention--.

Column 1, line 58, after "(Horsma et" insert --al) filed--.

Column 1 lines 64 to 66, replace "filed Jun. 3, 1988, now U.S. Pat. No. 4,910,389, 202,762 (Sherman et al.) filed June 3, 1988, 209,761 (Hughes et al.)" by --filed Jun. 3, 1988, 202,762 (Sherman et al.) filed June 3, 1988, now U.S. Pat. No. 4,910,389, 209,761 (Hughes et al.)--.

Column 3, line 39, replace "$T_s$ s" by --$T_s$ is--.

Column 5, line 41, replace "($T^m$ + 20)°C" by --($T_m$ + 20)°C--.

UNITED STATES PATENT AND TRADEMARK OFFICE

CERTIFICATE OF CORRECTION

PATENT NO. : 5,181,006

DATED : January 19, 1993

INVENTOR(S) : Shafe, et al

It is certified that error appears in the above-indentified patent and that said Letters Patent is hereby corrected as shown below:

Column 6, line 26, replace "120mesh" by --120 mesh--.

Column 7, line 40, replace "Norcot®)" by --Norcote®)--.

Column 8, Claim 5, line 13, before "applying" insert --(c)--.

Signed and Sealed this

Twenty-fifth Day of January, 1994

Bruce Lehman

*Attest:*

BRUCE LEHMAN

*Attesting Officer*

*Commissioner of Patents and Trademarks*